US006533483B2

(12) United States Patent
Carroll et al.

(10) Patent No.: US 6,533,483 B2
(45) Date of Patent: Mar. 18, 2003

(54) MULTI-MEDIA WRITING INSTRUMENTS AND METHODS FOR THEIR USE

(75) Inventors: Craig Carroll, Anaheim Hills, CA (US); Charles Richard Lewis, Jr., Palo Alto, CA (US); John Smith, San Francisco, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/990,918

(22) Filed: Nov. 13, 2001

(65) Prior Publication Data

US 2002/0057937 A1 May 16, 2002

Related U.S. Application Data

(60) Provisional application No. 60/248,363, filed on Nov. 14, 2000.

(51) Int. Cl.[7] ..... B43K 5/12

(52) U.S. Cl. ..... 401/194; 401/6; 401/29; 401/258

(58) Field of Search ..... 401/29, 30, 31, 401/32, 33, 194, 6, 258

(56) References Cited

U.S. PATENT DOCUMENTS

| | | | | | |
|---|---|---|---|---|---|
| 489,043 | A | | 1/1893 | Smith | |
| 1,304,590 | A | * | 5/1919 | Nardi | 401/33 |
| 1,689,390 | A | | 10/1928 | Johnstone | |
| 1,706,399 | A | | 3/1929 | Desemo | |
| 1,806,580 | A | * | 5/1931 | Barth | 401/194 |
| 2,123,810 | A | * | 7/1938 | Severin | 401/32 |
| 2,604,876 | A | | 7/1952 | Steuck | 120/14.5 |
| 2,636,598 | A | | 4/1953 | Hopgood | 206/56 |
| 2,781,741 | A | | 2/1957 | Tintner | 120/42.13 |
| 2,790,422 | A | * | 4/1957 | Grumbach, 2nd | 401/194 |
| 3,358,699 | A | | 12/1967 | Bau | 132/79 |
| 3,856,420 | A | | 12/1974 | Oltmann | 401/109 |
| 4,000,950 | A | | 1/1977 | Wahlberg | 401/32 |
| 4,148,591 | A | | 4/1979 | Tomura | 401/32 |
| 4,738,557 | A | | 4/1988 | Yumoto | 401/29 |
| 4,948,285 | A | | 8/1990 | Schleif | 401/195 |
| 5,026,190 | A | | 6/1991 | Longarzo | 401/30 |
| 5,642,953 | A | | 7/1997 | Kobayashi | 401/30 |
| 5,713,680 | A | | 2/1998 | Yoshino et al. | 401/30 |
| 5,909,975 | A | | 6/1999 | Kobayashi | 401/30 |
| 6,056,462 | A | * | 5/2000 | Fukai et al. | 401/6 |
| 6,062,753 | A | * | 5/2000 | Hadtke et al. | 401/6 |
| 6,146,038 | A | * | 11/2000 | Mittersinker et al. | 401/116 |

* cited by examiner

*Primary Examiner*—David J. Walczak
(74) *Attorney, Agent, or Firm*—Oppenheimer Wolff & Donnelly LLP

(57) ABSTRACT

Apparatuses and methods for providing a multi-media writing instrument having locking grips. The grips are locked into position so that they will not rotate around the outer diameter of the pen. In particular, the upper grip of the multi-media writing instrument contains an indicator which denotes to the user the type of writing element being used and acts to lock the grip in position.

32 Claims, 9 Drawing Sheets

55
31
35
2
40
40
40
25
30
32
2
22

33
43
55
31
35
2
22
10
25
17
18
16
15
20
30
32
2

43
55
2
15
25
17
18
16
10
20
30
2
22

31''''
20'
60'
31''
31
30

31''''
20'
60'
35'
30
31

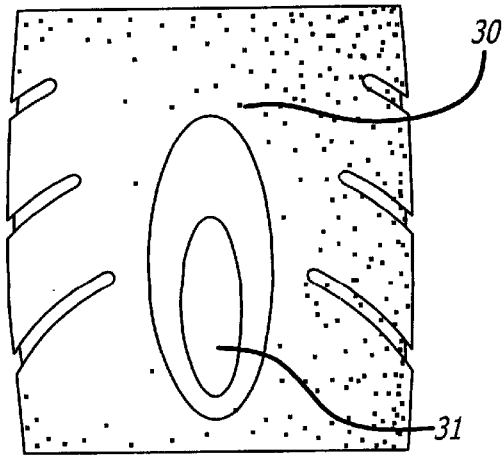
FIG. 10A
FIG. 10B
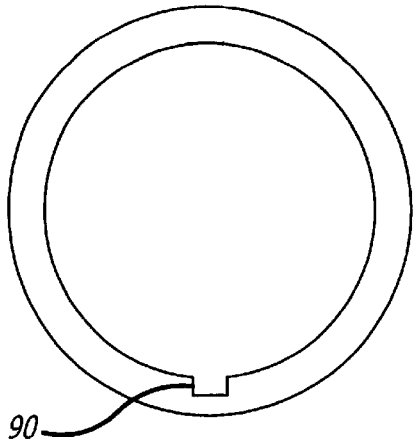
FIG. 10C
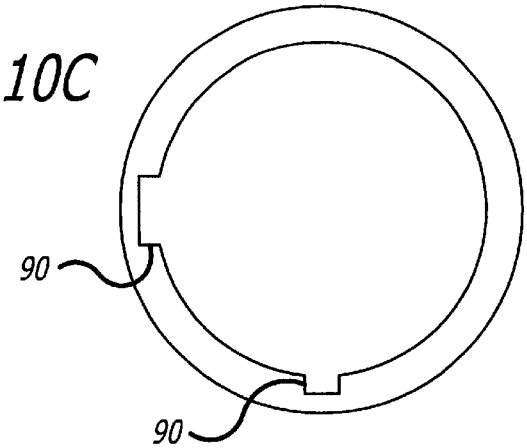
FIG. 10D
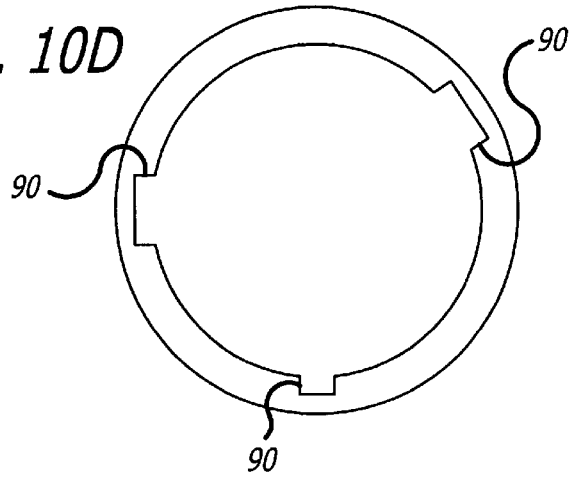

MULTI-MEDIA WRITING INSTRUMENTS AND METHODS FOR THEIR USE

RELATED APPLICATIONS

The present application claims priority to U.S. Provisional Application Ser. No. 60/248,363 previously filed on Nov. 14, 2000.

BACKGROUND OF THE INVENTION

1. Field of the Invention

The present invention relates in general to multi-media writing instruments and to methods for the manufacture and use of such writing instruments. More particularly, the present invention is directed to multi-media writing instruments having an integrated indicator grip.

2. General Background and State of the Art

Writing instruments vary in price, type, and features through technological advancements in material chemistry and improved manufacturing techniques. Given these advancements, writing instruments range from mass-produced plastic pens to fine writing instruments. The wide range of writing instruments vary in characteristics such as materials used, design, features, asethetics, perceived quality, details, utility, prestige, reputation, etc. Further adding to the differentiation amongst various writing instruments is the media used. That is, information may be conveyed by using ink, lead, paint, etc. Today, with the advent of personal data assistants, styluses are also used to input information.

Given the wide variety of writing instruments that an individual may use, multi-media writing instruments were developed. These writing instruments allowed the user to have one writing instrument that could alternate between different writing elements. A user could switch between different ink colors or switch between ink and pencil lead without having to switch to different writing instruments. This is more efficient to various users because the user does not have to carry a large number of writing instruments or alternate between various types of writing instruments. A user can simply carry and use a single writing instrument having different writing media elements.

Another feature that distinguishes writing instruments are features that make the writing instrument more comfortable to use. Various enhancements have improved the comfort level of writing instruments. The shape and size of writing instrument has been altered to provide a more comfortable writing position. For instance, various writing instruments have a larger diameter near the writing tip so that the user does not have to hold the device so tightly, thereby emulating a more natural hand position. Writing implements have changed in the materials used to form the shaft of the writing instrument. For instance, rubber and other like materials that provide more cushioning and better tactile feel. Additionally, there are after-market grips that slide onto various writing instruments that provide better hand ergonomics, cushioning, and overall comfort.

However, there have been many problems with the use of rubber grips. The rubber used to make the grips have different levels of shore hardness. Sure hardness is a measure of the softness of a particular compound. Generally, manufacturer want the grips to made from rubber with lower hardness levels, that is softer rubber. However, rubber with low sure hardness values tend to swell in response to extended contact with naturally-occurring body oils and elevated temperatures. This causes the rubber to grow in size which compromises the fit and finish of the rubber grip. That is, the rubber grip can rotate around the pen body or slide up and down the pen body. A solution has been to use rubber with higher sure hardness levels, but this tends to reduce the comfort level of the grip.

Writing instruments having multiple writing media elements have different means of switching between the different types of writing media. For instance, a writing instrument can switch between two different media by pushing a button or switching a lever. In particular applications, a portion of the pen housing will rotate relative to another portion of the pen housing wherein the rotation will cause the writing media to change. Usually, when the writing media is changed, there needs to be a way to discern between the different media being used. It is very difficult to discern what writing element you are using by just examining the writing instrument tip. There have been many designs where the writing instruments has various indicators and markings etched on the pen housing wherein when the pen is rotated the user is notified of what writing element is being used. There is a problem, however, when using a rubber grip and a rotating multi-media pen. When the grip swells, the indicator may incorrectly tell the user that they are using a particular media. This is particularly important when the pen contains different colors of ink. Additionally, this is important where a metal tip found on a mechanical pencil or pen may damage the screen of a personal data assistant.

Moderate improvements have been made when addressing the problem of using a multi-media pen and employing rubber grips. In particular, the indicator is painted on to the pen grip or stamped on to the pen grip, but there have been problems with quality and aesthetics. One solution has been co-molding an indicator with the grip, however, this is a very expensive manufacturing process, which requires expensive machinery. Additionally, time and complexity of manufacturing can not be justified for the retail price of the product. It is not economically feasible to produce such a product. Consequently, cost reduction and improved quality are continued goals when designing any writing instrument. Therefore, there exists a need to provide an improved writing instrument meeting predetermined requirements while meeting or exceeding current efficiencies in cost and production, while maintaining high fit and finish.

It is an object of the present invention to provide non-rotating upper and lower grips for a multi-media writing instruments.

It is another object of the present invention to provide a grip having an integrated indicator grip.

It is yet another object of the present invention to provide a multi-media writing instrument that is inexpensive to manufacture, easy to use, and is cost effective.

INVENTION SUMMARY

The present invention seeks to produce a multi-media writing instrument with a high quality fit and finish. Specifically, the present invention achieves this goal by having upper and lower grips that are locked into position. More particularly, the upper grip has an indicator which is also responsible for locking the grip into position. In achieving a higher fit and finish, the design of the present invention provides maintains a competitive cost and efficient manufacturing process.

The multi-media writing instrument comprises a first housing (distal housing) and a second housing (proximal housing). The second housing of the multi-media writing instrument is rotatively coupled to the first housing. A first grip is secured to the first housing by locking members that extend along the interior of the first grip. The first housing contains channels wherein these channels correspond to the location and size of the locking members of the first grip. The second housing includes a second grip that is locked into position. That is, the second grip will not slide or rotate around the axis of the second housing. The second grip of the present invention also includes an aperture that receives a locking member from an indicator sleeve. The locking member of this particular embodiment acts as both a locking member forte grip and as an indicator communicating the user the particular media that is selected.

Using a combination locking member improves the fit and finish of the writing instrument. First, the grip is locked into place with the locking member. This prevents the grip from sliding out of position or rotating about the outer diameter of the writing instrument. Next, it also provides greater aesthetics. A large plastic indicator clearly indicates the selected writing element. This results in consistent manufacturing quality at lower costs. On the other hand, painting an indicator or stamping an indicator in the aperture of the grip leads to varied quality and more expensive machinery.

To form the integrated indicator grip, an indicator sleeve (base sleeve) having a locking member is scoured to the housing of the writing instrument. A grip (gripping sleeve) having an aperture is then slipped over the indicator sleeve. Once in position, the locking member of the indicator sleeve protrudes through the aperture of the grip, thereby locking the grip into position. This process yields a product with high fit and finish while providing an efficient and inexpensive manufacturing process. The grip can be easily manufactured by simply sliding different elements over each other and having various lugs or other locking members to affix the yip in to proper position.

BRIEF DESCRIPTION OF THE DRAWINGS

FIG. 10A is another embodiment of the grip according to the present invention; and FIGS. 10B–10D is a cross-sectional view of the grip according to FIG. 10A illustrating at least one notch.

DETAILED DESCRIPTION OF THE PREFERRED EMBODIMENTS

This description is not to be taken in a limiting sense, but is made merely for the purpose of illustrating the general principles of the invention. The section titles and overall organization of the present detailed description are for the purpose of convenience only and are not intended to limit the present invention.

Figures 1A, 1B, 1C:
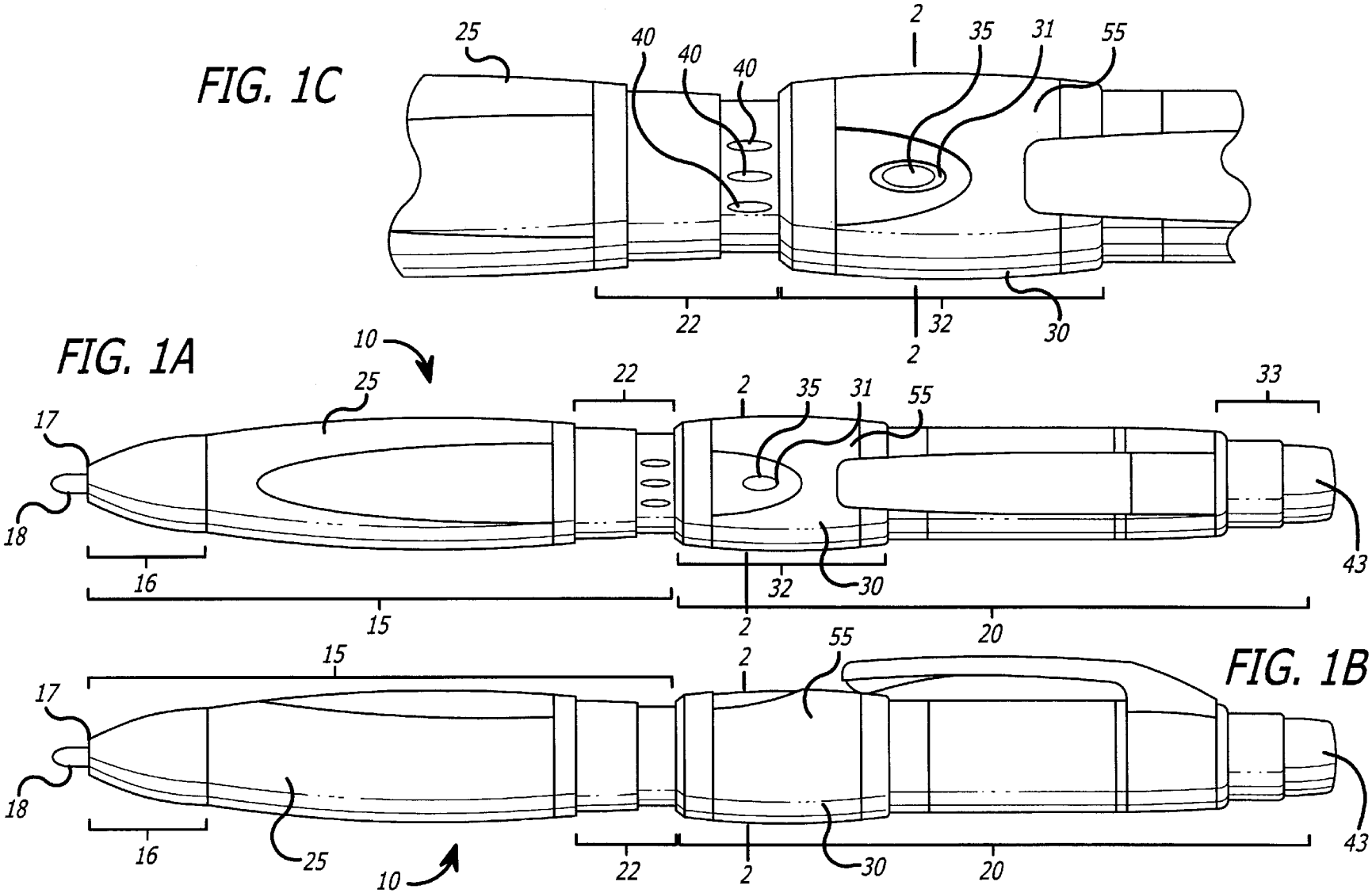
FIG. 1A is a top view of the multi-media writing instrument according to one embodiment of the present invention.
FIG. 1B is a side view of the multi-media writing instrument according to FIG. 1A.
FIG. 1C is an exploded top view of the second grip assembly according to FIG. 1A.
Figure 2A:
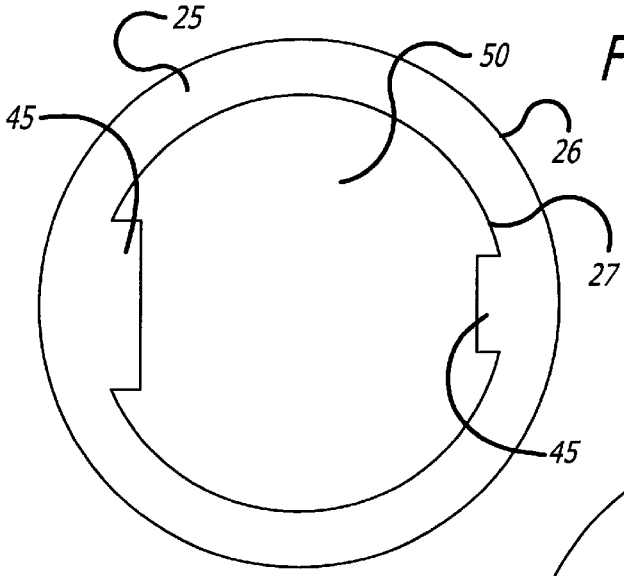
FIGS. 2A through 2D are end views of alternate embodiments of the first grip of the present invention.
Figure 2B:
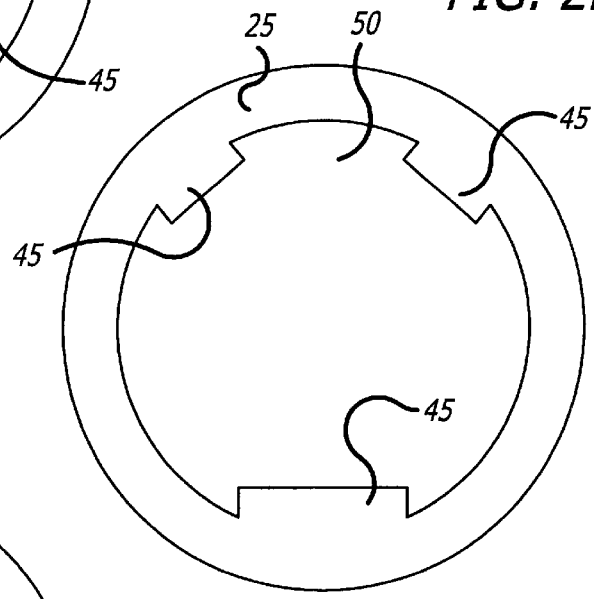
Figure 2C:
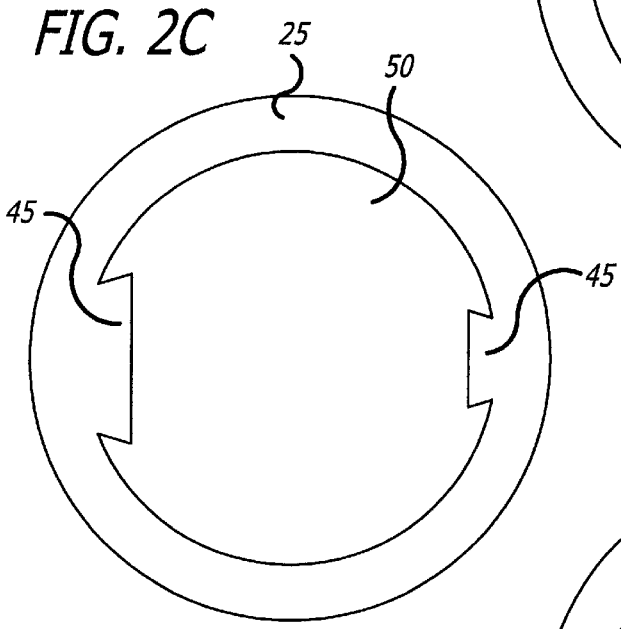
Figure 2D:
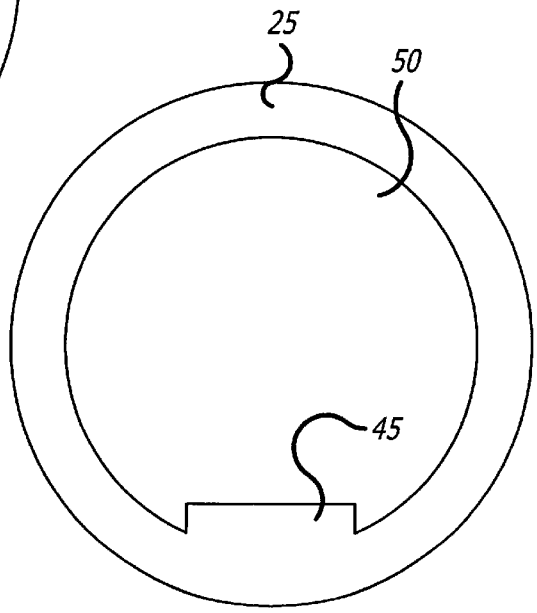

FIG. 1A illustrates the top view of a multi-media writing instrument 10 of the present invention. The writing instrument 10 includes a first housing 15 and a second housing 20. The first housing and second housing are rotatively coupled to each other. That is, the first housing 15 and second housing 20 are attached so that the housings may rotate relative to one another. The first housing 15 and the second housing 20 are generally cylindrical in shape. The first housing is torpedo-shaped where the distal portion 16 of the first housing is smaller in size than the proximal portion 22 of the first housing.

The first housing has a first grip 25 secured to the outer surface of the first housing. The first grip substantially encompasses the outer diameter of the first housing. Additionally, the first grip 25 substantially covers the whole length of the first housing. By substantially covering most of the first housing with the grip 25, the present invention provides a large soft area improving writing comfort.

The first grip 25 is typically made from rubber, but those skilled in the art will appreciate that the first grip may be made from a variety of materials that are resilient, flexible, and soft. The grip 25 may also have various designs embossed on the outer surface. As shown in FIGS. 1A and 1C, an oval design is embossed in the grip.

At the distal portion 16 of the first housing, writing elements 18 protrude through an opening 17 at the proximal end 16. The distal portion 16 of the first housing is made from plastic or other like material. The distal portion is typically made of plastic so that the glass surface of personal data assistants (PDAs) are not scratched when using the writing instrument of the present invention.

At the proximal portion 22 of the first housing, there are a plurality of markings (first and second indicators) 40 that correspond to the selected writing element 18. FIGS. 1A end 1C illustrate the pen having three markings 40. However, those skilled in the art will appreciate that the number of markings may vary. Different writing elements may be used with the present invention. It is contemplated that the end user of the present invention may select from at least two different writing elements. In the present invention, a pen, stylus, and pencil are contemplated to be the different writing elements. However, those skilled in the art will appreciate that various combinations of pen color, pencil lead widths, markers, highlighters may be selected.

FIGS. 1A and 1B illustrate the second housing 20 of the present invention. The second housing includes an integrated indicator grip 55 at the distal end 32 of the second housing 20. A button 43 is located at the proximal end 33 of the second housing 20. If the mechanical pencil media is selected, depressing the button 43 advances the stored mechanical lead out of the opening 17 of the first housing.

Referring to FIGS. 1A and 1C, an embodiment of the integrated indicator grip 55 is shown. The integrated indicator grip 55 includes a second grip 30 and an indicator icon (cooperative indicator) 35. The indicator icon 35 protrudes through an aperture 31 of the second grip as shown in FIGS. 1A and 1C. The aperture or opening in FIG. 1C is oval-shaped, but it is contemplated that aperture may be shaped in various forma such as a circle, rectangle, or a triangle. As shown in FIG. 1C, the indicator is aligned with markings on the first housing which indicate the selected writing element. The second housing with the second grip may be rotated relative to the first housing and switched between the different markings on the first housing. It is also contemplated that the second grip way include multiple apertures and one marking on the proximal portion of the lower housing.

FIG. 2 is an end view the first grip 25 of the present invention is illustrated. The first grip 25 is generally cylindrical in shape having an inner surface 27 and an outer surface 26. The inner surface 27 of the first grip has at least one locking member 45 protruding into the lumen 50 of the first grip. FIGS. 2A through 2C show the first grip having at least two locking members. The locking members 45 are disposed generally in a radial fashion around the inner surface of the first grip, and the locking members tend to extend substantially along the length of the first grip. The first grip is locked into a fixed position by interacting with corresponding locking channels associated with the first housing.

Figure 3B:
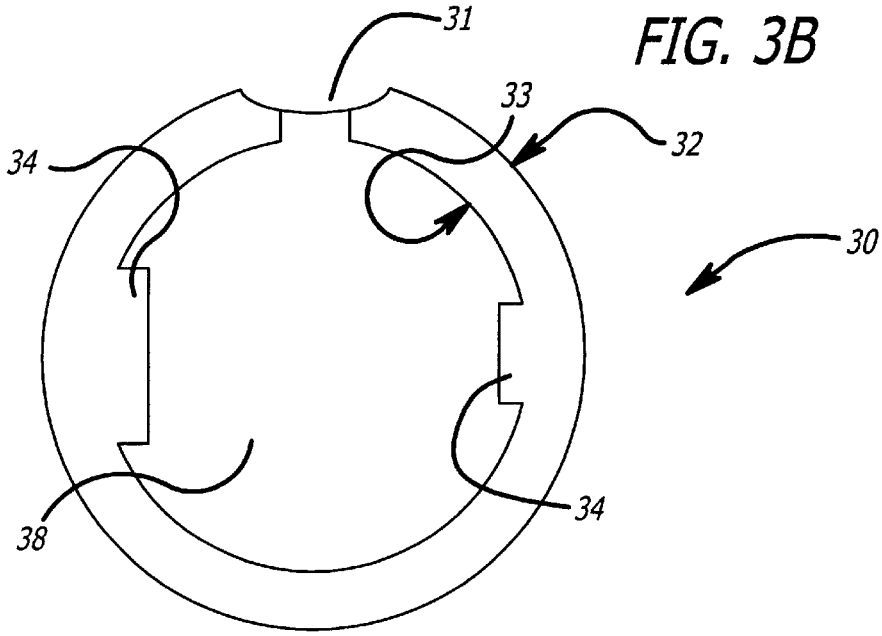
FIG. 3B is an end view of the second grip of the present invention.
Figure 3A:
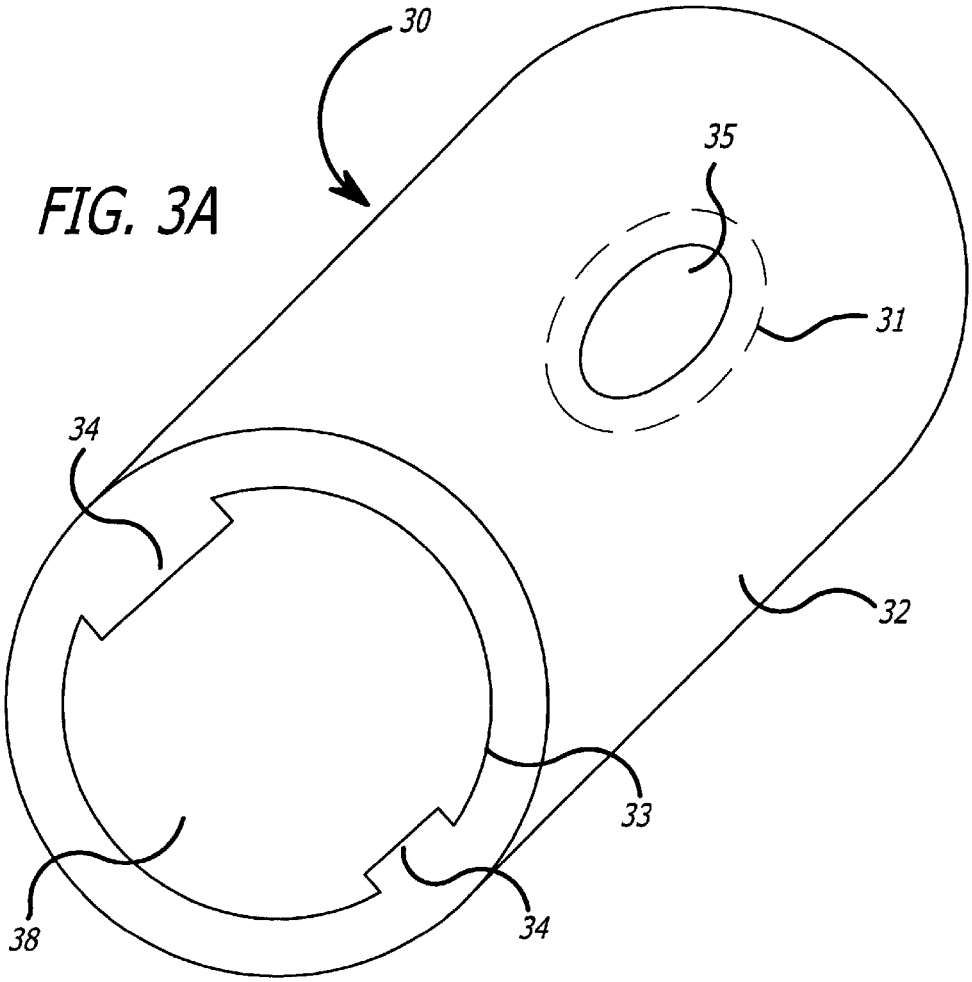
FIG. 3A is a perspective view of the second grip of the present invention.
Figure 4A:
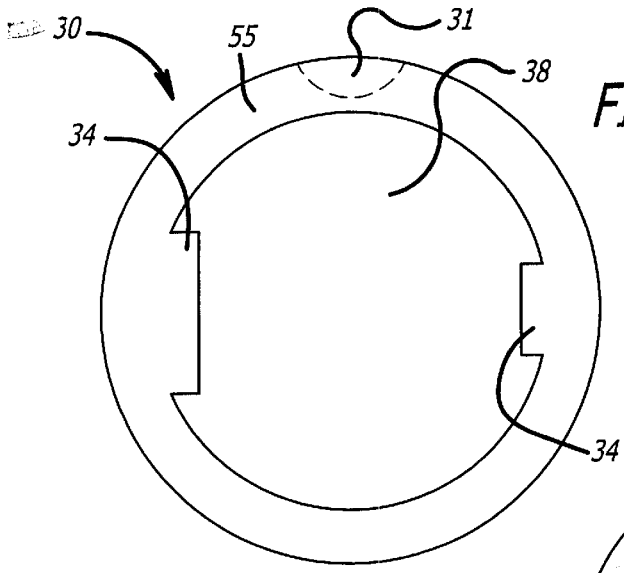
FIGS. 4A through 4D are end views of alternate embodiments of the second grip of the present invention.
Figure 4B:
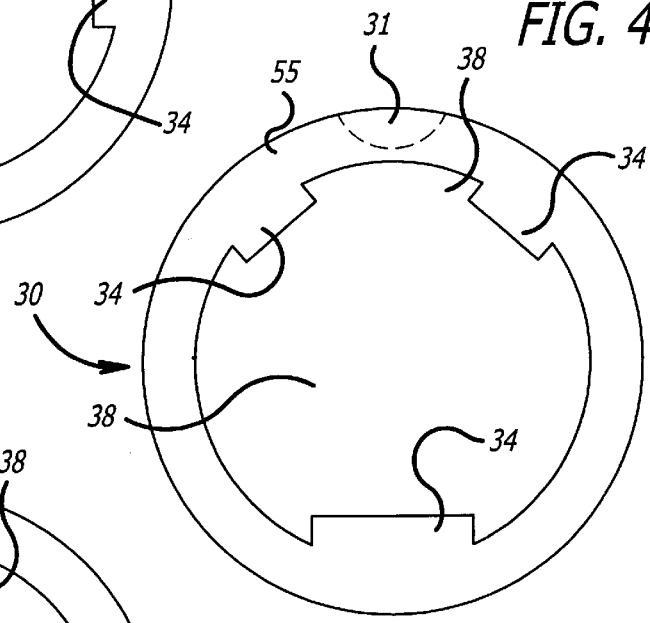
Figure 4C:
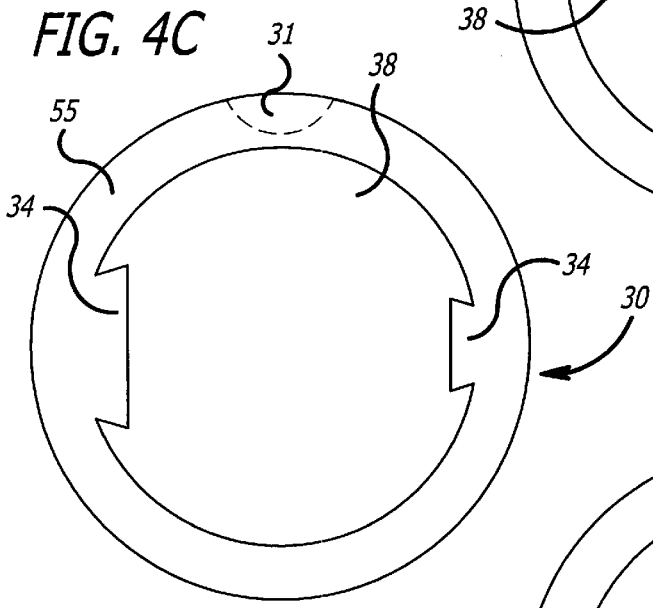
Figure 4D:
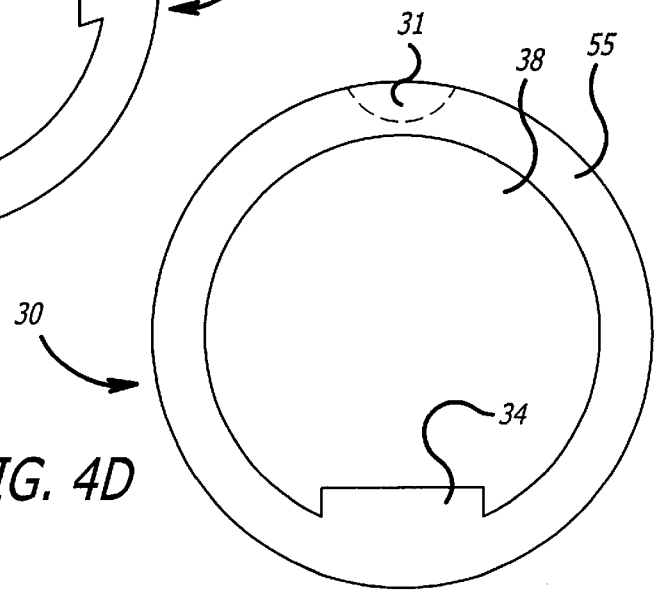

FIG. 3A is a perspective view of the second grip 30. The second grip 30 includes an inner surface 33 and an outer surface 32, wherein the inner surface 33 may contain locking members 34 protruding into a lumen 38 as shown in FIG. 3A. Typically, there is at least one locking member 34 on the second grip. The locking members of the second grip vary in various dimensions. For instance, a locking member may differ from another locking member in width or height. That is, the height of the locking member being amount of the locking member protrudes into the lumen of the grip.

The second grip 30 also has an aperture 31 or opening where an indicator 35 may protrude through the aperture. The aperture in FIG. 3A is oval, but it is also contemplated that the aperture may be shaped as a circle, triangle, rectangle, arrow, or the like. FIGS. 3A and 3B illustrate a grip having one aperture, but those skilled in the art will appreciate tat the grip may be provided with more than one aperture.

FIG. 3B shows an end view of the second grip. In FIG. 3, the locking members 34 are on opposite poles and are of different widths. FIGS. 4A–4D illustrate various alternate embodiments of the second housing having a plurality of locking members of differing sizes. However, it is also contemplated that the locking members may be similar in size and in different locations.

Figures 5A, 5B, 5C:
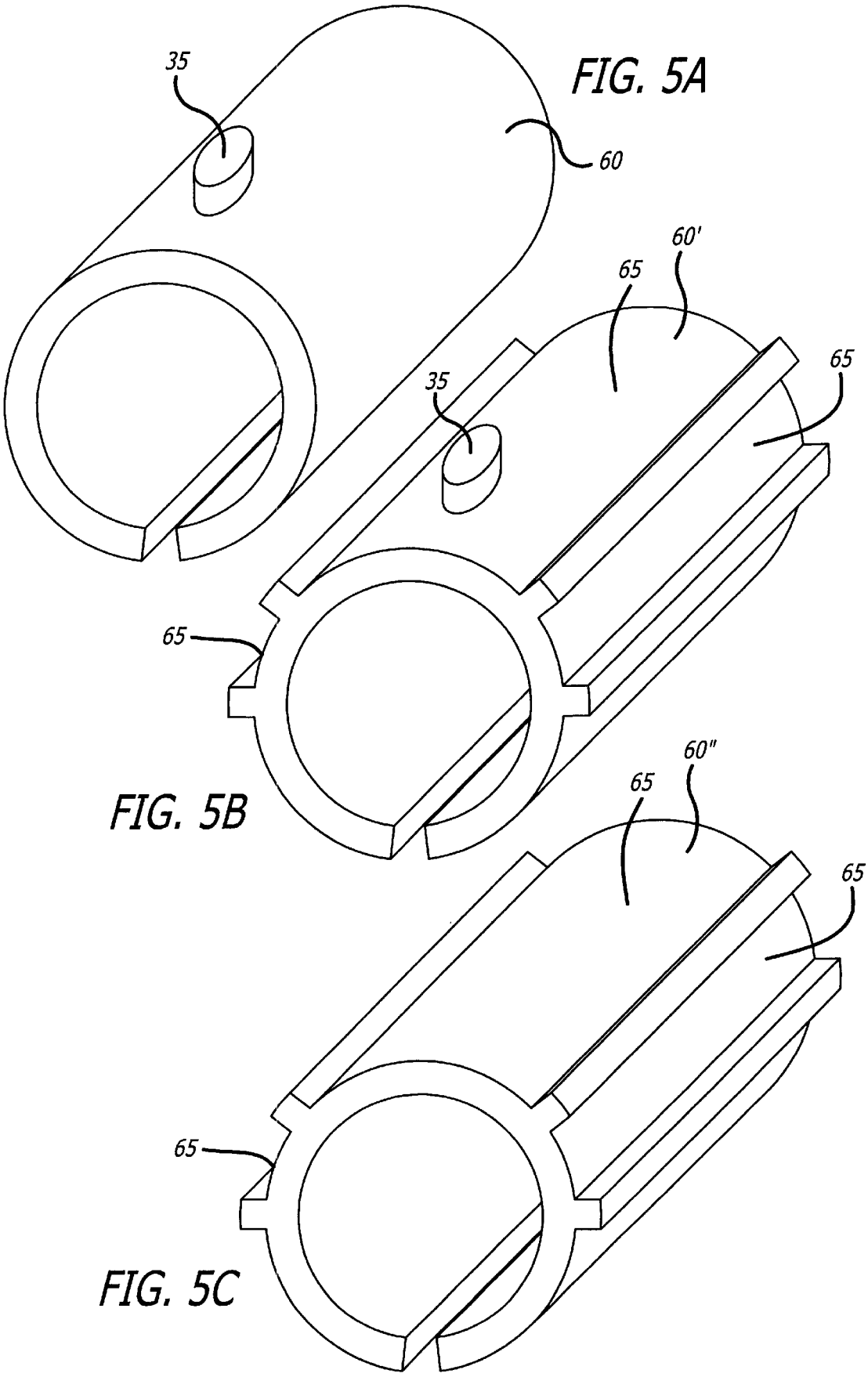
FIG. 5A is a perspective view of the indicator sleeve of the present invention.
FIG. 5B is an alternate embodiment of the indicator sleeve of the present invention.
FIG. 5C is another alternate embodiment of the indicator sleeve of the present invention.

Referring to FIG. 5A, the indicator sleeve 60 of the present invention is illustrated. As shown in FIG. 5A, the indicator sleeve 60 is generally cylindrical in shape having an indicator icon 35 extending from the outer surface of the indicator sleeve. The indicator icon 35 of the present invention is shaped so that the locking icon member 35 will fit snugly in the aperture 31 of the second grip 30. In this particular embodiment, the indicator icon 35 is a combination indicator and locking member. That is, the indicator icon performs a dual function. The indicator icon holds the grip 30 in a fixed position while indicating what writing media was selected.

The indicator sleeve is generally made from polyethylene, but it is also contemplated that other plastics and polymers may be used to form the indicator sleeve. The indicator sleeve is generally of a different color than the second grip, but it is contemplated that the indicator can be the same color as the second grip.

FIG. 5B illustrates an alternate embodiment of the indicator sleeve 60'. The indicator sleeve 60' includes various locking channels 65 that will accept the locking members 34 from the second grip 30. The interaction between the sides of the locking channels and the corresponding locking member of the grip hold the grip in a fixed position. In FIG. 5B, there is also an indicator icon that provides an additional locking point between the grip and the indicator sleeve. However, it is also contemplated that another embodiment of the indicator sleeve 60" does not include an indicator icon as illustrated in FIG. 5C.

Figures 6, 7A, 7B:
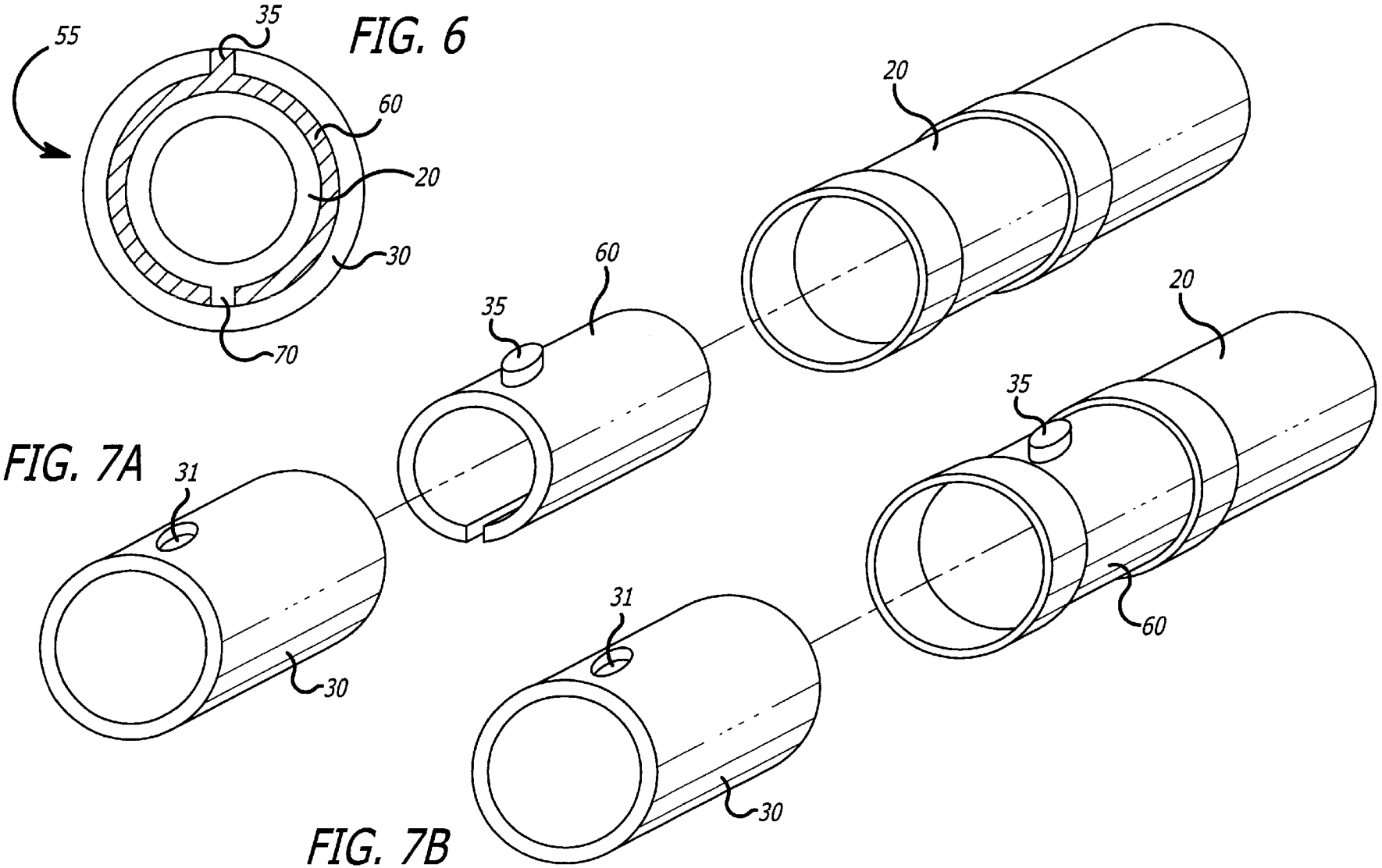
FIG. 6 is a cross sectional end view of the completed second grip assembly taken along line 2—2 of FIGS. 1A through 1C.
FIGS. 7A and 7B is an exploded perspective view of the second grip assembly of the present invention.

FIG. 6 refers to a cross-sectional end view of the integrated indicator grip 55 taken along line 2—2 of FIGS. 1A through 1C. The indicator sleeve 60 is coupled to the second housing 20 by simple mechanical interaction. In particular, the ends of the indicator sleeve engage a brace 70 that extends from the surface of the second housing. However, those skilled in the art will appreciate that the indicator sleeve 60 may be attached to the second housing 20 by gluing or using other fastening means to attach the indicator sleeve 60 to the second housing 20. The second grip 30 surrounds the combined second housing 20 and the indicator sleeve 60 to form the completed integrated indicator grip 55. The indicator icon 35 protrudes through an aperture 31 on the second grip 30. Note that in this embodiment, the inner surface of the second grip is smooth and the indicator icon 35 protruding from the aperture 31 prevents the second grip from rotating relative to the second housing.

FIG. 7A illustrates an. exploded perspective view of the components comprising the integrated indicator grip 55. The indicator sleeve 60 is coupled to the proximal portion of the second housing 20 as shown in FIG. 7B. That is, the indicator sleeve is attached to the middle area of the spool-shaped distal portion of the second housing. Generally, the distal portion of the second housing is spool-shaped. That is, the outer rims or ridges of the distal end second housing is larger in diameter than the area bounded by the outer rims or ridges. The second grip is then slid over the combined indicator sleeve and second housing. By providing a spool-shaped distal area, the overall diameter of the assembled integrated indicator grip does not greatly exceed the overall diameter of the upper housing.

In an alternate embodiment, the second grip is locked into a fixed position by interacting with locking channels located on the second housing. More particularly, the locking members from the second grip engage the locking channels of the second housing thereby forming a tongue and groove arrangement so that the second grip will not rotate about the axis of the second housing.

Figure 8A:
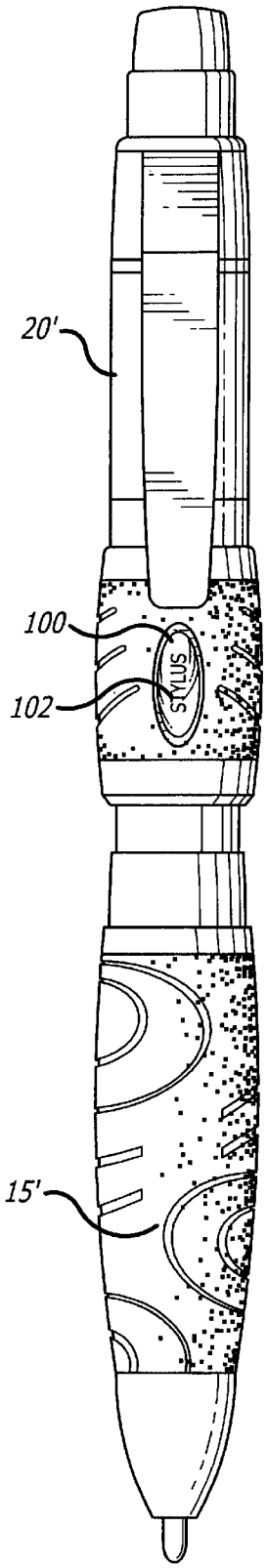
FIG. 8A is a top view of another embodiment of the multi-media writing instrument according to the present invention having the lower housing in a first position.
Figure 8B:
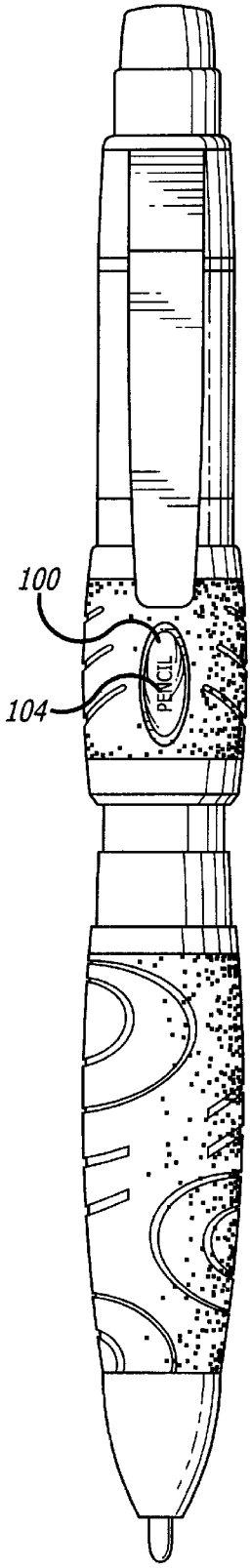
FIG. 8B is a top view of the multi-media writing instrument according to FIG. 8A having the lower housing in a second position.
Figure 8C:
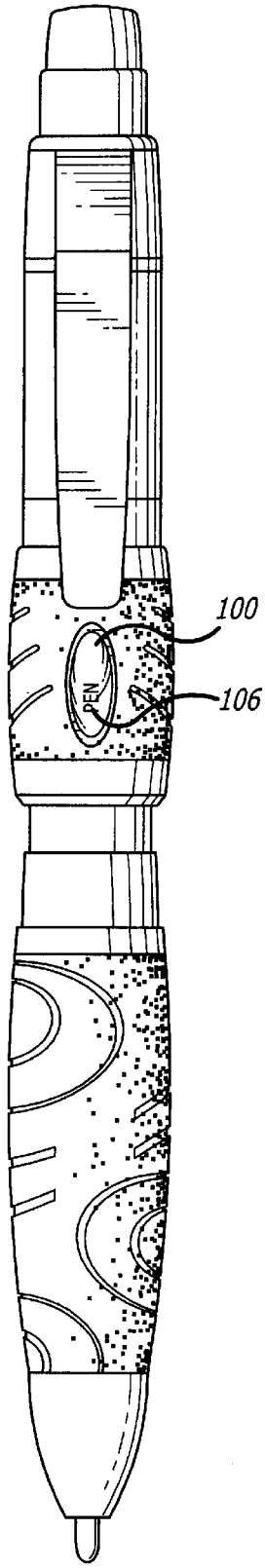
FIG. 8C is a top view of the multi-media writing instrument according to FIG. 8A having the lower housing in a third position.

FIGS. 8A–8C illustrate by way of example a window 100 formed in the second grip in accordance with yet another embodiment of the present invention. In this embodiment, the descriptions of the writing media are printed on the distal end of the first housing 15' so that they may be seen through the window 100 on the second housing 20'. That is, the window 100 is formed all the way through the second housing 20'. In particular, FIG. 8A illustrates the first housing 15' in the first position relative to the second housing 20' showing the description "stylus" 102 through the window 100; likewise, FIG. 8B illustrates the first housing 15' in the second position relative to the second housing 20' showing the description "pencil" 104 through the window 100; and FIG. 8C illustrates the first housing 15' in the third position relative to the second housing 20' showing the description "pen" 106 through the window 100. This way, when a user rotates the second housing 20' relative to the first housing 15' in any of the three positions, the window 100 aligns with the corresponding description to indicate to the user which writing element has been selected, i.e., stylus, pencil, or pen in this example.

Moreover, the first housing 15' may rotate partially or rotate completely around, i.e., 360°, relative to the second housing 20'. In this particular example, if the first housing 15' rotates completely around the second housing 20', and there are three positions, then each position may be equally apart, i.e., 120° apart from one another.

Figures 9A, 9B:
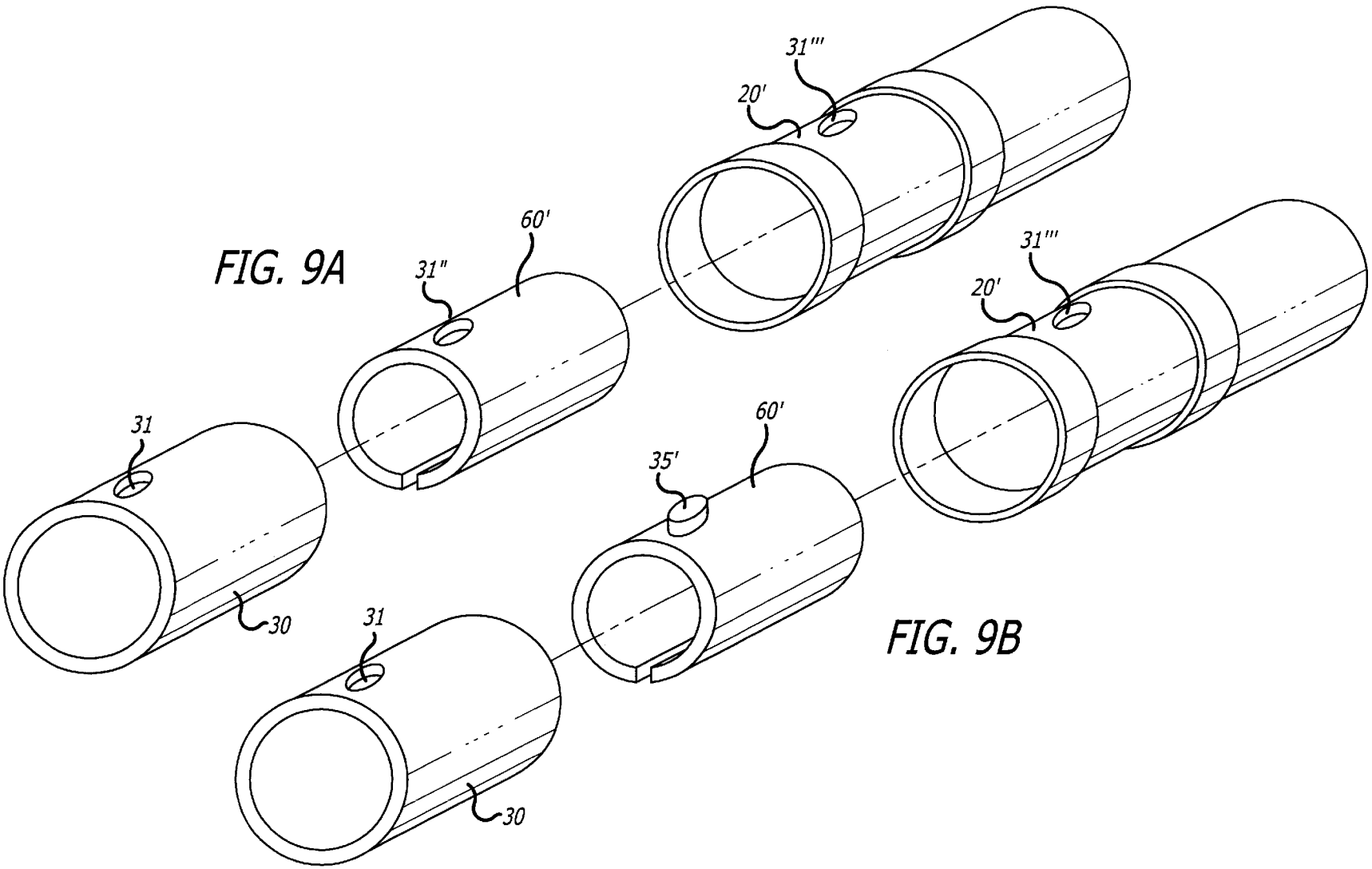
FIG. 9A is an exploded perspective view of the grip assembly according to another embodiment of the present invention.
FIG. 9B is an exploded perspective view of the grip assembly according to yet another embodiment of the present invention.

FIG. 9A illustrates by way of example the formation of the window 100 that includes the aperture 31 in the second grip 30, aperture 31" in the sleeve 60', and aperture 31'" in the second housing 20', all aligning together. This way the three descriptions on the distal portion of the first housing may be seen through the window 100. Moreover, as shown in FIGS. 10A–10D, at least one notch 90 may be formed within the interior surface of the grip 30, and a corresponding tab on the sleeve 60' so that the they do not rotate relative to each other.

Alternatively, the aperture 31 in the second grip 30 may covered with a transparent material, such as glass and plastic to protect the description and to prevent dust from getting into the window 100. Moreover, the multi-media writing instrument 10 is not limited to three positions, i.e., the writing instrument 10 may have two positions or more than three positions.

FIG. 9B illustrates yet another exemplary window 100 where the sleeve 60' includes a transparent icon 35' protruding through the aperture 31 in the second grip 30, and aligns with the aperture 31'" in the second housing. This way, the description in the first housing may be seen through the transparent icon 35'; and at the same time, the icon 35' holds the second grip 30 in place. Still further, the second housing may be made of transparent material so that no aperture 31'" needs to be formed in order to see the description in the second housing through the icon 35'. Alternatively, the transparent material over the window 100 and the icon 35' may magnify the description in the second housing for easy viewing. Still further, the printed descriptions may be printed in different colors to further assist the operator in determining the engaged writing media.

The completed pen provides a high quality, multi-media pen having a dual grip system whereby the grips are locked into a fixed position. The grips are locked in position by locking members and their corresponding locking channels. By locking these grips into position, the embossed designs on the upper and lower grips can be aligned resulting in an aesthetically pleasing product with an appearance of high quality. The indicator provides two-fold function, locking the second grip into position and acting as a pointer. That is, the indicator directs the user to particular markings on the pen housing which indicate which writing element is being used.

Those skilled in the art will further appreciate that the present invention may be embodied in other specific forms without departing from the spirit or central attributes thereof. In that, the foregoing description of the present invention discloses only exemplary embodiments thereof, it is to be understood that other variations are contemplated as being within the scope of the present invention. According, the present invention is not limited in the particular embodiments which have been describe in detail therein. Rather, reference should be made to the appended claims as indicative of the scope and content of the present invention.

While the specification describes particular embodiments of the present invention, those of ordinary skill can devise variations of the present invention without departing from the inventive concept.

We claim:

1. A multi-media writing instrument comprising:

a first housing and a second housing, wherein the second housing is rotatively coupled to the first housing;

a first grip secured to the first housing;

an indicator sleeve having at least one locking member, wherein the indicator sleeve is secured to the second housing;

a second grip having an aperture, the second grip juxtaposed to the indicator sleeve, wherein the at least one locking member protrudes through the aperture, whereby the at least one locking member prevents the second grip from rotating relative to the second housing.

2. The multi-media writing instrument of claim 1 wherein the first grip substantially overlays the first housing.

3. The multi-media writing instrument of claim 2 wherein the first grip wraps around an outer diameter of the first housing.

4. The multi-media writing instrument of claim 1 wherein the first grip has an outer and an inner surface, the inner surface having at least one locking ridge protruding from the inner surface into a lumen of the first grip.

5. The multi-media writing instrument of claim 4 wherein the first housing has at least one locking channel, wherein the at least one locking channel engages the locking ridge of the first grip.

6. The multi-media writing instrument of claim 5 wherein the number of the locking ridges and the locking channels are equal.

7. The multi-media writing instrument of claim 1 wherein the at least one locking member is a combination locking member and device indicator.

8. The multi-media writing instrument of claim 1 wherein the at least one locking member is transparent.

9. A multi-media writing instrument, comprising:

a proximal housing;

a distal housing rotatably coupled to and extending longitudinally out from the proximal housing;

first and second writing media alternatively positionable by a user in operative positions relative to the distal housing;

first and second indicators supported by and rotatable with the distal housing;

a cooperative indicator supported by and rotatable with the proximal housing;

the cooperative indicator being positionable in alternative first and second positions relative to the first and second indicators by rotation of one of the housings with respect to the other;

with the cooperative indicator in the first position, the first writing media is in the operative position and the cooperative indicator is in a longitudinal alignment with the first indicator;

with the cooperative indicator in the second position, the second writing media is in the operative position and the cooperative indicator is in the longitudinal alignment with the second indicator;

a gripping sleeve having an aperture and positionable around the proximal housing; and the cooperative indicator being positioned in the aperture and thereby at least in part preventing rotation of the gripping sleeve about the proximal housing.

10. The writing instrument of claim 9 wherein the gripping sleeve includes two apertures.

11. The writing instrument of claim 9 wherein the gripping sleeve has an inner surface that is smooth about its entire circumference and along its entire length.

12. The writing instrument of claim 9 wherein the gripping sleeve has an outer surface and an inner surface, the inner surface having a plurality of locking ridges.

13. The writing instrument of claim 12 wherein the plurality of locking ridges have different widths.

14. The writing instrument of claim 12 wherein the locking ridges engage with locking channels on a base grip preventing relative rotation.

15. The writing instrument of claim 14 wherein the gripping sleeve is secured to the proximal housing and has a window.

16. The writing instrument of claim 9 further comprising a first, second, and third writing media alternatively positionable by a user in operative positions relative to the distal housing.

17. A multi-media writing instrument, comprising:

a distal housing having a proximal portion;

first and second writing media alternatively positionable by a user in operative positions relative to the distal housing;

the proximal portion having first and second indicia, the first indicia corresponding to the first writing media, and the second indicia corresponding to the second writing media;

a proximal housing rotatably coupled to the distal housing wherein the distal housing extends out from the proximal housing;

the proximal housing having a distal portion;

a gripping sleeve secured to the proximal housing and having a window;

a base sleeve between the proximal housing and the gripping sleeve, the gripping sleeve juxtaposed to the distal portion of the proximal housing;

the window being aligned with the first indicia when the first writing media is in the operative position so that the first indicia can be viewed through the window to indicate to a user that the first writing media is in the operative position; and the window being aligned with the second indicia when the second media is in the operative position so that the second indicia can be viewed through the window to indicate to a user that the second writing media is in the operative position.

18. The writing instrument of claim 17 wherein the window is covered by a transparent material.

19. The writing instrument of claim 17 further comprising a first, second, and third writing media alternatively positionable by a user in operative positions relative to the distal housing.

20. The writing instrument of claim 17 further comprising a third writing media positionable by a user in operative positions relative to the distal housing.

21. The writing instrument of claim 20 wherein the first, second, and third writing media include a stylus, a pen, and a pencil, respectively.

22. A method for using a multi-media writing instrument, comprising:

providing a distal housing having a proximal portion;

providing first and second writing media alternatively positionable by a user in operative positions relative to the distal housing;

providing the proximal portion having first and second indicia, the first indicia corresponding to the first writing medium, and the second indicia corresponding to the second writing medium;

providing a proximal housing rotatably coupled to the distal housing wherein the distal housing extends out from the proximal housing;

providing a proximal housing having a distal portion;

providing a gripping sleeve secured to the proximal housing and having a window;

providing a base sleeve between the proximal housing and the gripping sleeve, the gripping sleeve juxtaposed to the distal portion of the proximal housing;

aligning the window, by turning the proximal housing relative to the distal housing, with the first indicia to place the first writing medium in an operative position so that the first indicia can be viewed through the window to indicate to a user that the first writing medium is in the operative position; and after the aligning the window with the first indicia, aligning the window, by turning the proximal housing relative to the distal housing, with the second indicia to place the second medium is in an operative position so that the second indicia can be viewed through the window to indicate to a user that the second writing medium is in the operative position.

23. The method of claim 22 further comprising providing a third writing media wherein the first, second, and third writing media are alternatively positionable by a user in operative positions relative to the distal housing.

24. A multi-media writing instrument, comprising:

a first housing having a distal portion wherein the distal portion has a description for each of a corresponding writing media;

a second housing rotatively coupled to the first housing;

a grip secured to the first housing;

a sleeve between the second housing and the first grip, the sleeve juxtaposed to the distal portion of the first housing;

a window on the second housing so that the description for each of the corresponding writing media on the distal portion of the first housing can be seen through the window on the second housing;

wherein the window is formed through a first aperture on the second housing, a second aperture on the sleeve, and a third aperture on the grip, all aligned together.

25. The writing instrument of claim 24 wherein the window is covered by a transparent material.

26. A multi-media writing instrument, comprising:

a first housing having a distal portion wherein the distal portion has a description for each of a corresponding writing media provided by a multi-media writing instrument;

a second housing rotatively coupled to the first housing;

a grip secured to the first housing;

a sleeve between the second housing and the first grip, the sleeve juxtaposed to the distal portion of the first housing; and a window on the second housing so that the description for each of the corresponding writing media on the distal portion of the first housing can be seen through the window on the second housing;

wherein the window is formed through a first aperture on the second housing, a transparent icon on the sleeve, and a second aperture on the grip, wherein the first and second apertures align together and the transparent icon protrudes through the second aperture of the grip.

27. A multi-media writing instrument, comprising:

a first housing having a distal portion wherein the distal portion has a description for each of a corresponding writing media provided by a multi-media writing instrument;

a second housing rotatively coupled to the first housing;

a grip secured to the first housing;

the grip having an interior surface;

a sleeve between the second housing and the first grip, the sleeve juxtaposed to the distal portion of the first housing;

the sleeve having an outer surface;

at least one notch on the inner surface of the grip that engages with a corresponding tab on the outer surface of the sleeve preventing rotation relative to each other;

a window on the second housing so that the description for each of the corresponding writing media on the distal portion of the first housing can be seen through the window on the second housing;

wherein the window is formed through a first aperture on the second housing, a second aperture on the sleeve, and a third aperture on the grip, wherein the first, second, and third apertures align together.

28. The writing instrument of 27 wherein the second aperture is covered with a transparent material.

29. A writing instrument, comprising:

a housing;

a grip having at least one aperture;

a sleeve between the housing and the grip, the sleeve having an indicator, wherein the indicator protrudes through the aperture of the grip and locks onto the housing; and wherein the grip has an outer surface and an inner surface, the inner surface having a plurality of locking ridges;

wherein the plurality of locking ridges have different widths.

30. A multi-media writing instrument, comprising:

a distal housing having a proximal portion;

first and second writing media alternatively positionable by a user in operative positions relative to the distal housing;

the proximal portion having first and second indicia, the first indicia corresponding to the first writing media, and the second indicia corresponding to the second writing media;

a proximal housing rotatably coupled to the distal housing wherein the distal housing extends out from the proximal housing;

the proximal housing having a distal portion;

a gripping sleeve secured to the proximal housing and having a window;

a base sleeve between the proximal housing and the gripping sleeve, the gripping sleeve juxtaposed to the distal portion of the proximal housing;

at least one of an inner surface of the gripping sleeve and an outer surface of the base sleeve has at least one ridge and the other has at least one channel, the at least one ridge engaging in a respective one of the at least one channel; and the at least one ridge engaging in a respective one of the at least one channel preventing rotation of the gripping sleeve about the proximal housing.

31. The writing instrument of claim 30 further comprising a third writing media, and wherein the first, second, and third writing media are alternatively positionable by a user in operative positions relative to the distal housing.

32. The writing instrument of claim 30 wherein the inner surface of the gripping sleeve has the at least one ridge, and the outer surface of the base sleeve has the at least one channel, the at least one ridge engaging in a respective one of the at least one channel.

* * * * *